US005358390A

United States Patent [19]

Jäger

[11] Patent Number: 5,358,390

[45] Date of Patent: Oct. 25, 1994

[54] ECCENTRIC SCREW PUMP

[76] Inventor: Arnold Jäger, Gehrbergsweg 6, 3167 Burgdorf, Fed. Rep. of Germany

[21] Appl. No.: 138,487

[22] Filed: Oct. 15, 1993

[30] Foreign Application Priority Data

Nov. 11, 1992 [DE] Fed. Rep. of Germany ..... 4237966

[51] Int. Cl.[5] ..... F01C 1/10

[52] U.S. Cl. ..... 418/48

[58] Field of Search ..... 418/48

[56] References Cited

U.S. PATENT DOCUMENTS 4,104,009 8/1978 Chanton ..... 418/48
4,773,834 9/1988 Saruwatari ..... 418/48

FOREIGN PATENT DOCUMENTS 0209099 1/1987 European Pat. Off. .
0279093 5/1990 Fed. Rep. of Germany ..... 418/48
0799996 7/1956 United Kingdom ..... 418/48

*Primary Examiner*—Richard A. Bertsch
*Assistant Examiner*—Charles G. Freay
*Attorney, Agent, or Firm*—Robert W. Becker & Associates

[57] ABSTRACT

An eccentric screw pump having a rigid rotor, which is embodied as a spiral and has a circular cross-sectional configuration, and also having a stator that is provided with an elastic lining that delimits a cavity which accommodates the rotor and has the form of a spiral with a cross-sectional configuration that essentially has the shape of a rectangle bounded on opposite sides by a respective semicircle. The sides of the essentially rectangular portion that interconnect the semicircles, proceeding essentially from the semicircles, are provided with projections that bulge convexly in a direction toward an interior of the cavity of the stator. In the vicinity of the inlet end of the stator, the projections bulge inwardly to a lesser extent than at the pressure side of the stator.

14 Claims, 2 Drawing Sheets

ECCENTRIC SCREW PUMP

BACKGROUND OF THE INVENTION

The present invention relates to an eccentric screw pump having a rigid rotor, which is embodied as a spiral, for example a single spiral or helix, and has a circular cross-sectional configuration, and also having a stator that is provided with an elastic or elastomeric lining that delimits an interior space or cavity which accommodates the rotor and has the form of a spiral, for example a double spiral or helix, with a cross-sectional configuration that essentially has the shape of a rectangle bounded on opposite sides by a respective semicircle, whereby the sides of the essentially rectangular portion that interconnect the two semicircles, proceeding essentially from the semicircles, are provided with projections that bulge convexly in a direction toward the interior of the cavity of the stator.

With such a pump (see German Auslegescrift 20 17 670), the convexly bulging or projecting edges result in an increase in the conveying capacity because these edges or sides take into account the fact that the amount of the cavity reduction effected by the sides is approximately proportional to the respectively adjoining thickness of the layer of the elastomeric material of the stator. The greater pressure of the elastomeric material against the rotor caused by the convex surfaces thus reduces the so-called clearance losses and hence increases the pump capacity. Unfortunately, counteracting this advantage is the drawback that the friction losses of the pump increase with an increase of the pressure of the elastomeric material against the rotor, which is particularly disadvantageous for longer pumps of, for example, several meters length.

It is therefore an object of the present invention to eliminate these drawbacks; relatively reduced friction losses should be tolerated without however thereby having to accept greater clearance losses.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
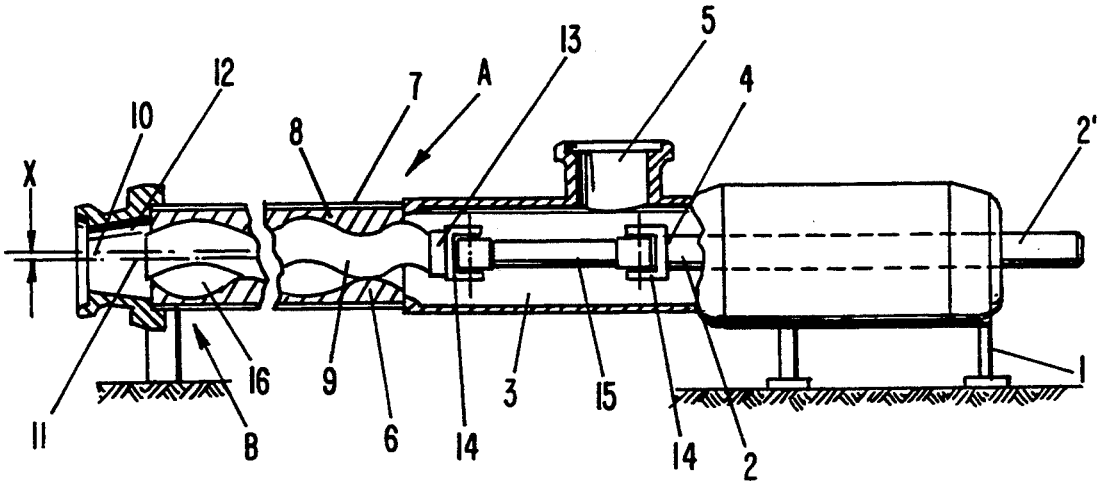
FIG. 1 is a longitudinal cross-sectional view of one exemplary embodiment of the inventive eccentric screw pump.

The eccentric screw pump of the present invention is characterized primarily in that in the vicinity of the inlet end of the stator, the projections of the sides of the essentially rectangular portion of the cross-sectional configuration of the stator bulge inwardly to a lesser extent than at the pressure side of the stator, whereby at the inlet end of the stator, it is possible to provide no or practically no bulge.

The present invention proceeds from the recognition that the pressure within the stator increases from the inlet side thereof to the pressure side thereof. In the regions of low internal pressure, in which the losses due to clearance are slight anyway, no or only slight bulges are provided pursuant to the present invention, and in particular with correspondingly slight friction losses, whereas in the stator regions of greater internal pressure, where greater displacement of the elastomer takes place, a good sealing effect is ensured.

It should be noted that the magnitude of the bulges can be about 1–4% of the thickness of the respectively adjacent elastomeric material. Of course, this value must be adapted to the deformability of the elastomeric material and to the pressure head and effective length of the stator involved.

The change in the amount of bulge from the inlet side to the pressure side of the stator can be effected in stages over the length of the stator. However, it is also possible to provide a gradual change, for example allowing the bulge to slowly increase from a value of 0 mm to a value of approximately 4% of the aforementioned thickness of the elastomeric material.

Another important feature is that to avoid the clearance losses, it is generally not necessary to change the contour of the pump cavity in the region of the two semicircles, which are adapted to the diameter of the rotor; in other words, it is not necessary to reduce the spacing between the two semicircles in order to increase the preload because in these cross-sectional areas the thickness of the elastomeric material is relatively small and hence cannot readily deform.

Further specific features of the present invention will be described in detail subsequently.

DESCRIPTION OF PREFERRED EMBODIMENTS

Referring now to the drawing in detail, the base of the pump includes support means 1 that serve for mounting the drive shaft 2. This drive shaft has a projecting stub or connector 2' to which is connected the drive motor. The end 4 of the drive shaft 2 extends into the inlet or intake chamber 3 of the pump. The inlet connection of the pump is designated by the reference numeral 5.

The most important part of the pump is the stator 6, which has a rigid shell or casing 7 and an inwardly disposed lining 8 that is made of an elastomeric material, preferably rubber, and defines an interior space or pump cavity 16 in the form of a double spiral or helix for accommodating the rotor 9, which is in the form of a single spiral or helix. The longitudinal axis of the rotor 9 is designated by the reference numeral 10; the rotor 9 carries out a rotation about the axis 11 of the stator 6, while at the same time carrying out a rotational movement about its own longitudinal axis 10. The longitudinal axis 10 of the rotor 9 is spaced by the distance "x" from the axis 11 (amount of eccentricity). The pressure delivery connection 12 closes off the pump on the pressure side B. In addition, the stator 6 is removably held between the connection 12 and the housing that forms the inlet chamber 3.

Due to the eccentric movement and the stress of the pump, an elastic coupling element 15 is provided between the end 4 of the drive shaft 2 and the forward stub 13; the coupling element 15 is held by claws or dogs 14. It should be noted that other proven transfer elements could also be used in place of the elongated coupling element 15.

The important aspect of the present invention is that over the length of the stator 6 the chamber 16 does not have a constant inner contour; rather, the inner contour of the stator varies over its length.

Figure 2:
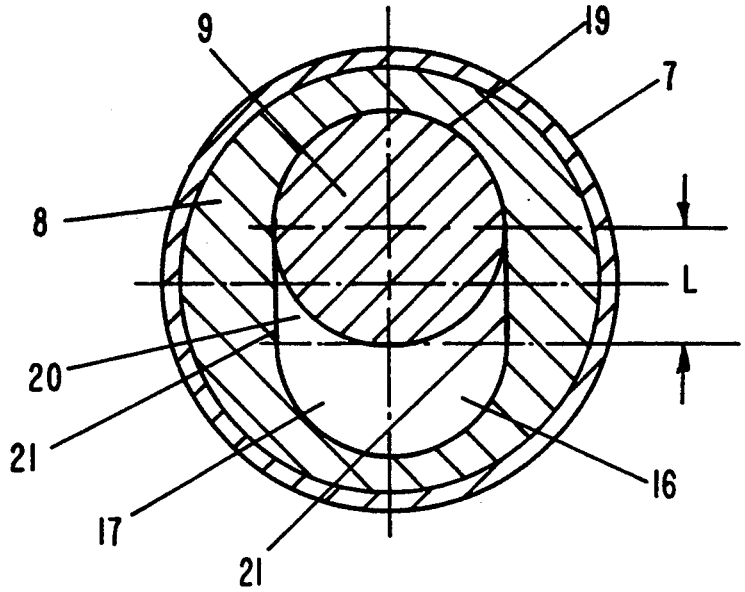
FIG. 2 is a cross-sectional view through the stator and rotor at the intake or inlet side of the pump.

FIG. 2 shows how at the inlet or intake side A the cross-sectional area of the chamber 16 is formed by two semicircles 17, 19 and a rectangle 20. The rotor 9, which has a circular cross-sectional configuration, moves in this cross-sectional area.

The stroke of the rotor 9 corresponds to the length L of the rectangle of the rectangular surface 20 disposed between the two semi-circular surfaces 17, 19; the determining sides of the rectangle are formed by the two parallel, linearly extending sides 21. Under these conditions, the rotor 9 can flushly contact the two semicircles and the two sides 21, although already here the lining 8 can rest against the rotor 9 with a slight preload.

Figure 3:
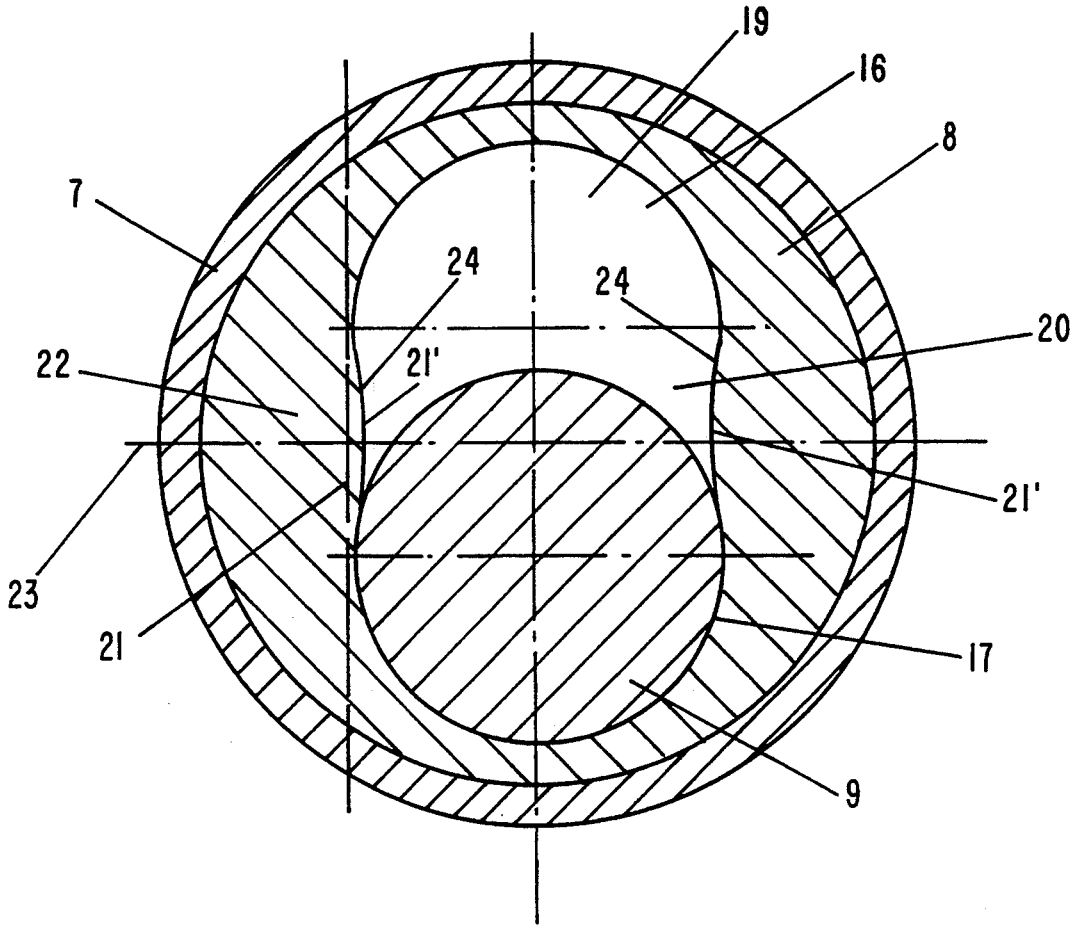
FIG. 3 is a cross-sectional view through the stator and rotor at the pressure side of the pump.

As can be seen from the cross-sectional view of FIG. 3, which is taken at the pressure side B, the two semicircles 17, 19 remain unchanged, and are also spaced the same distance from one another; however, the two edges or sides 21' no longer extend linearly, but rather are convexely bulged in a direction toward the interior of the cavity 16, and in particular are bulged in a smooth or stepless manner proceeding from the ends of the two semicircles. This takes into consideration the situation that the local thickness of the adjacent elastic layer at 22, and hence also the elastic resilience thereof relative to the center line 23, increases and in zones of the greatest elastic deformation deflects or turns aside the internal pressure in a more pronounced manner relative to the other rubber zones, for example in the region of the semi-circular areas 17, 19. This means that as a consequence of the projections or bulges 24 relative to the sides 21, the losses due to clearances between the lining 8 and the rotor 9 are reduced.

Since the internal pressure in the stator 6 builds up gradually in a direction .toward the connection 12, a correspondingly increasing bulge 24 is therefore selected. In this connection, a continuous increase can be provided, or the increase of the projection or bulge 24 can occur in stages. In addition, it is also possible to already provide a slight bulge 24 at the inlet side A of the stator, at which location the entire periphery of the cavity 16 can also provide for a preloaded contact of the lining 8 against the rotor 9. In the last-mentioned situation, the radius of the two semicircles 17, 19 must then be slightly less than the radius of the rotor 9.

It should be noted that the magnitude of the greatest thickness of the bulge 24 is to be coordinated with the hardness of the lining 8 and the pump pressures; this can be determined by appropriate tests. This wall thickness should generally be approximately 1–4% of the adjacent thickness in the region of the center line 23 when the lining 8 has a hardness of approximately 58–65 Shore A.

It should also be noted that the number of spirals of the rotor on the one hand and of the stator cavity on the other hand must be adapted to one another, whereby generally a single spiral rotor calls for a double spiral stator (in conformity with the illustrated embodiment). Thus, from this structural principle for the types of pumps under consideration, the stator has a greater number of spirals than does the rotor.

Furthermore, in addition to the aforementioned physical properties, the lining 8 can have Shore A harnesses of about 55–75 in order to satisfy all requirements that are encountered in practice. In addition, it is possible for the bulge to have a thickness of approximately 1–20% of the adjacent thickness of the lining in the region of the center line, with the higher values being used for particularly long and also soft linings 8.

Reference has been made to the fact that the rotor 9 contacts the lining 8, i.e., the semi-circular surfaces 17, 19 and the sides 21'. In this connection, it should be noted that at a given cross-section, the preload of the lining 8 against the rotor 9 is at least nearly the same in the region of the semi-circular surfaces 17, 19 as in the region of the sides 21'.

The present invention is, of course, in no way restricted to the specific disclosure of the specification and drawing, but also encompasses any modifications within the scope of the appended claims.

What I claim is:

1. An eccentric screw pump, comprising:

a rigid rotor, which is embodied as a spiral and has a circular cross-sectional configuration; and a stator that is provided with an elastic lining that delimits an interior cavity which accommodates said rotor and has the form of a spiral with a cross-sectional configuration that essentially has the shape of a rectangle bounded on opposite sides by a respective semicircle, whereby those sides of the essentially rectangular portion that interconnect said semicircles, proceeding essentially from said semicircles and over at least most of a length of said stator, are provided with projections that bulge convexly in a direction toward an interior of said cavity of said stator, whereby in the vicinity of an inlet end of said stator, said projections of said sides of said essentially rectangular portion of said cross-sectional configuration of said stator bulge inwardly to a lesser extent than at a pressure end of said stator.

2. An eccentric screw pump according to claim 1, wherein at said inlet end of said stator, said sides of said essentially rectangular portion extend linearly.

3. An eccentric screw pump according to claim 1, wherein the extent to which said projections bulge inwardly increases gradually from said inlet end of said stator to said pressure end thereof.

4. An eccentric screw pump according to claim 1, wherein the extent to which said projections bulge inwardly increases in stages from said inlet end of said stator to said pressure end thereof.

5. An eccentric screw pump according to claim 1, wherein the amount by which said projections bulge varies in conformity with an increase in pressure within said stator.

6. An eccentric screw pump according to claim 1, wherein said lining has a Shore A hardness of approximately 58 to 65, and the maximum thickness of said projections is equal to about 1 to 4% of the thickness of an adjacent part of said lining in the vicinity of an imaginary center line of said stator that extends transverse to a longitudinal direction of said stator.

7. An eccentric screw pump according to claim 1, wherein over the length of said stator, said lining has an at least nearly constant thickness, and hence preload, in the vicinity of said semicircles of said cross-sectional configuration of said stator.

8. An eccentric screw pump according to claim 1, wherein said lining has a Shore A hardness of approximately 55–75.

9. An eccentric screw pump according to claim 1, wherein the maximum thickness of said projections is equal to 1 to 20% of the thickness of said lining in the vicinity of an imaginary center line of said stator that extends transverse to a longitudinal direction of said stator.

10. An eccentric screw pump according to claim 7, wherein at a given cross-section along the length of said stator, both said semicircles as well as said sides of said essentially rectangular portion that interconnect said semicircles have at least nearly the same preload.

11. An eccentric screw pump according to claim 1, wherein the extent to which said projections bulge inwardly increases from said inlet end of said stator to said pressure end thereof.

12. An eccentric screw pump according to claim 1, wherein at said inlet end of said stator, said sides of said essentially rectangular portion extend at least substantially linearly.

13. An eccentric screw pump, comprising:

a rigid rotor, which is embodied as a spiral and has a circular cross-sectional configuration; and a stator that is provided with an elastic lining that delimits an interior cavity which accommodates said rotor and has the form of a spiral with a cross-sectional configuration that essentially has the shape of a rectangle bounded on opposite sides by a respective semicircle, whereby those sides of the essentially rectangular portion that interconnect said semicircles, proceeding essentially from said semicircles and over at least most of a length of said stator, are provided with projections that bulge convexly in a direction toward an interior of said cavity of said stator, whereby in the vicinity of an inlet end of said stator, said projections of said sides of said essentially rectangular portion of said cross-sectional configuration of said stator bulge inwardly to a lesser extent than at a pressure end of said stator, and wherein over the length of said stator, said lining has an at least nearly constant thickness, and hence preload, in the vicinity of said semicircles of said cross-sectional configuration of said stator.

14. An eccentric screw pump, comprising:

a rigid rotor, which is embodied as a spiral and has a circular cross-sectional configuration; and a stator that is provided with an elastic lining that delimits an interior cavity which accommodates said rotor and has the form of s spiral with a cross-sectional configuration that essentially has the shape of a rectangle bounded on opposite sides by a respective semicircle, whereby those sides of the essentially rectangular portion that interconnect said semicircles, proceeding essentially from said semicircles and over at least most of a length of said stator, are provided with projections that bulge convexly in a direction toward an interior of said cavity of said stator, whereby in the vicinity of an inlet end of said stator, said projections of said sides of said essentially rectangular portion of said cross-sectional configuration of said stator bulge inwardly to a lesser extent than at a pressure end of said stator, and wherein the maximum thickness of said projections is equal to 1 to 20% of the thickness of said lining in the vicinity of an imaginary center line of said stator that extends transverse to a longitudinal direction of said stator.

* * * * *